US008443473B2

(12) United States Patent
Maxwell

(10) Patent No.: US 8,443,473 B2
(45) Date of Patent: May 21, 2013

(54) PATIENT POSITIONING FRAME DEVICE AND APPLICATION TECHNIQUE

(76) Inventor: John A Maxwell, Medina, WA (US)

( * ) Notice: Subject to any disclaimer, the term of this patent is extended or adjusted under 35 U.S.C. 154(b) by 589 days.

(21) Appl. No.: 12/428,437

(22) Filed: Apr. 22, 2009

(65) Prior Publication Data

US 2009/0265853 A1 Oct. 29, 2009

Related U.S. Application Data

(60) Provisional application No. 61/125,329, filed on Apr. 23, 2008.

(51) Int. Cl.
*A61G 13/00* (2006.01)

(52) U.S. Cl.
USPC ..... 5/648; 5/650; 5/652

(58) Field of Classification Search
USPC ..... 5/30, 632, 648, 650, 652
See application file for complete search history.

(56) References Cited

U.S. PATENT DOCUMENTS

| | | | | |
|---|---|---|---|---|
| 2,577,177 A | | 9/1947 | Anderson, Roger | |
| 4,398,707 A | | 8/1983 | Cloward | |
| 4,444,381 A | | 4/1984 | Wayne | |
| 4,583,725 A | | 4/1986 | Arnold | |
| 4,662,619 A | * | 5/1987 | Ray et al. | 5/624 |
| 4,712,781 A | | 12/1987 | Watanabe | |
| 5,009,407 A | | 4/1991 | Watanabe | |
| 5,121,961 A | * | 6/1992 | Marshall | 297/17 |
| 5,444,882 A | * | 8/1995 | Andrews et al. | 5/618 |
| 5,603,692 A | * | 2/1997 | Maxwell | 602/28 |
| 5,725,486 A | * | 3/1998 | Engelman | 602/5 |
| 6,250,712 B1 | * | 6/2001 | Livington et al. | 297/4 |
| 6,523,201 B1 | * | 2/2003 | De Michele | 5/648 |

(Continued)

FOREIGN PATENT DOCUMENTS

WO 2006/110703 A2 10/2006

OTHER PUBLICATIONS

Park, Chang Kil MD, "The Effect of Patient Positioning on Intraabdominal Pressure and Blood Loss in Spinal Surgery," Anesth. Analg., vol. 91, pp. 552-557 (2000).

*Primary Examiner* — William Kelleher
(74) *Attorney, Agent, or Firm* — Ann W. Speckman; Speckman Law Group PLLC

(57) ABSTRACT

Devices and methods of the present invention are directed to positioning a patient in a prone position that exposes the posterior thoracic lumbar spine during a surgical procedure, such as a laminectomy procedure. The device has at least three support members, with a first support member configured and adapted to support at least a portion of a patient's torso and the patient's hips; a second support member, generally contiguous with the first, configured and adapted to contact a patient's thighs and to position the patient's thighs in a desired angular position relative to the patient's hips and torso; and a third support member, generally contiguous with the second support member, adapted to support a patient's knees and lower legs and to position the patient's lower legs in a desired angular position relative to the patient's torso and thighs. A patient is positioned in the frame device prior to being anesthetized while the patient is lying supine and, during or following administration of anesthesia, the patient (mounted in the device) is rolled onto an operating table and positioned in a prone position. Operation on the posterior thorical-lumbar spine in this position is especially advantageous, and the spinal canal remains virtually bloodless, providing excellent visualization during the surgical procedure. When the surgery is finished, the process is reversed.

20 Claims, 4 Drawing Sheets

U.S. PATENT DOCUMENTS 6,557,197 B1 * 5/2003 Graham ..... 5/630
6,640,368 B2 * 11/2003 Roston ..... 5/648
6,810,543 B2 * 11/2004 Fuhriman ..... 5/632
7,234,180 B2 6/2007 Horton et al.
7,351,216 B2 * 4/2008 Walsh ..... 602/33
7,716,764 B2 * 5/2010 Joe et al. ..... 5/655

* cited by examiner

PATIENT POSITIONING FRAME DEVICE AND APPLICATION TECHNIQUE

REFERENCE TO PRIORITY APPLICATION

This application claims priority to U.S. Patent Application No. 61/125,329 filed Apr. 23, 2008, which is incorporated herein by reference in its entirety.

FIELD OF INVENTION

The present invention relates to a frame device for holding and positioning a patient undergoing a thoraco lumbar laminectomy. Methods for positioning a patient in the frame device and positioning the loaded device on a support platform (e.g., an operating table) are also disclosed.

BACKGROUND OF THE INVENTION

Many types of support structures for holding and positioning patients during various diagnostic and therapeutic medical procedures are known in the art. Surgical tables and accessories for positioning a patient in a prone position are disclosed, for example, in U.S. Pat. Nos. 2,577,177; 4,398,707; 4,444,381; 4,583,725; 4,662,619; 4,712,781; 5,009,407; 5,444,882; 7,234,180 and WO 2006/110703. The advantages of using a Wilson laminectomy frame, which maintains patients in a prone position for spinal surgery and reduces Intraabdominal Pressure (IAP) to reduce venous blood loss during spinal surgery is described by Chang Kil Park, MD, *Anesth Analg* 2000; 91:552-7. One disadvantage of using various types of frame devices devised previously has been the enormous effort needed to lift and position the patient. This is why only a few academic centers use the position; they have the staff necessary to do the heavy lifting.

Despite the knowledge that positioning a patient in a prone position is advantageous, none of the prior art devices or techniques has provided satisfactory results. The present invention is directed to providing a frame device that maintains a patient in a knee-chest, kneeling, prone position during a laminectomy procedure and provides improved reductions in IAP and venous blood loss and improved visibility to the surgeon during the procedure.

SUMMARY OF THE INVENTION

The frame devices and application techniques of the present invention are directed to maintaining a patient in a position that exposes the posterior thoracic lumbar spine to perform surgical procedures. The frame device maintains the patient in a knee/chest, kneeling, prone position during a procedure, which is very advantageous for the surgeon in laminectomy procedures. The frame device and positioning techniques of the present invention are much better in reducing Intraabdominal Pressure (IAP) and venous blood loss during spinal surgery than the Wilson frame.

In one embodiment, the frame device comprises at least three support members arranged at angles to one another. A patient support surface of a first support member is configured and adapted to support a lateral portion of a patient's torso and the patient's hips. A second support member, generally contiguous with the first, is configured and adapted to contact a patient's thighs and to position the patient's thighs in a desired angular position relative to the patient's hips and torso. A third support member, generally contiguous with the second support member, is adapted to support a patient's knees and lower legs and to position the patient's lower legs in a desired angular position relative to the patient's torso and thighs. The support members may be contiguous with one another and fabricated as an integral, single piece device in which the support members are provided in fixed positions relative to one another. Alternatively, the angular positions of the support members may be adjustable with respect to one another to provide adjustable positioning and, optionally, to provide folding or rearrangement of the support members in a compact arrangement for storage and/or transport of the frame device. Velcro® straps or other types of fasteners may be provided to retain the patient in the frame device.

The frame device is adapted to be mounted or supported on a platform structure, such as an operating table. In general, a surface underlying the first, torso-supporting member is adapted to contact and be supported by a platform structure and may be detachably mounted on or fastened to the platform structure. The angular interface between the first and second support members is positioned at an end of the platform, and the third support member may optionally be supported by a lower support platform. By letting the abdomen hang free, epidural bleeding within the spinal canal is virtually eliminated.

In practice, according to one method, a patient is positioned in the frame while awake and while the patient is lying, supine, on a stretcher. In many situations, only one adjustment is necessary, and that involves an adjustment for the length of the femur. This adjustment may be accomplished by shortening or lengthening the middle support member, or by using thicker or thinner pads on the surface of the third support member positioned underneath the patient's knees. As endotrachael anesthesia is induced, the patient is positioned in the frame, the frame is affixed to the patient with Velcro® straps, and the patient is then rolled prone onto a pre-set operating table. Operation on the posterior thorical-lumbar spine is usually some form of laminectomy in the spinal canal and, in this position, the operation is virtually bloodless, which provides dramatically improved visualization for the surgeon, with or without a microscope.

When the surgical procedure is finished, the process is reversed. A stretcher may be positioned adjacent the operating table. The anesthetized patient, attached to the frame device and positioned in a prone position on the operating table, is rolled off of the operating table and onto the stretcher to the supine position, or to a position on his or her side. The frame is removed while the anesthesia is reversed, and the patient awakens in the supine position, or in a position on his or her side.

BRIEF DESCRIPTION OF THE DRAWINGS

Specific embodiments of the positioning frame device and application techniques of the present invention are described with reference to the following figures, in which.

DETAILED DESCRIPTION OF THE INVENTION

While the present invention is described more fully hereinafter with reference to the accompanying drawings, in which particular components and embodiments are shown and described, it is to be understood that persons having skill in the art may modify the components and embodiments described herein without departing from the spirit of the invention. Accordingly, the embodiments that are illustrated and the detailed descriptions that follow are intended to be illustrative and exemplary of specific structures and embodiments, without limiting the broad scope of the invention.

Patient frame device 100, as illustrated in the figures, comprises at least three support members arranged or arrangeable at desired angular positions with respect to one another. A first support member 110 is adapted to support at least a portion of a patient's torso and a patient's hips; a second support member 120, generally contiguous with the first, is adapted to contact a patient's thighs and to position the patient's thighs in a desired angular position relative to the patient's hips and torso; and a third support member 130, generally contiguous with the second support member, is adapted to support a patient's knees and lower legs and to position the patient's lower legs in a desired angular position relative to the patient's torso and thighs. The first, second and third support members may be generally flat structures or they may have contoured surfaces that support the relevant portion of the patient's anatomy in a generally planar configuration. The support members are generally constructed from a substantially rigid material that supports the weight of the patient. Materials such as hard plastics, fiberglass, composite materials, carbon fiber compositions, and similar materials are suitable for constructing the frame device.

Figure 3:
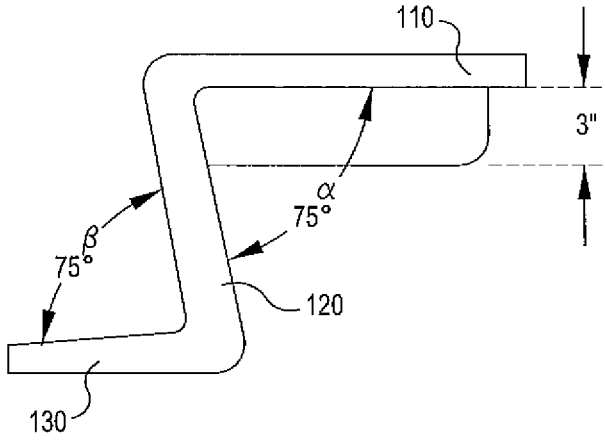
FIG. 3 is a schematic diagram illustrating the planes of the supporting members in a simplified format to illustrate the angular relationships of the supporting members with respect to one another.

The first and second support members 110 and 120, respectively, are configured and positioned or positionable relative to one another such that their support planes are arranged at an angle $\alpha$ (formed between surfaces opposite the patient contacting surfaces of the first and second members and illustrated in FIG. 3A). According to some embodiments, the first and second support members 110 and 120, respectively, are positioned or positionable relative to one another at an angle $\alpha$ of less than about 90°, more generally from about 60° to about 90° relative to one another, and preferably about 75° relative to one another, as illustrated in the schematic diagram of FIG. 3A. The second and third support members 120 and 130, respectively, are configured and positioned or positionable relative to one another such that their support planes are arranged at an angle $\beta$ (formed between patient contacting surfaces of the second and third members and illustrated in FIG. 3A) of from about 60° to about 120°. According to some embodiments, the second and third support members 120 and 130, respectively, are positioned or positionable relative to one another at an angle $\beta$ of less than about 110°, more generally from about 60° to about 100° relative to one another, and preferably about 75° relative to one another, as illustrated in the schematic diagram of FIG. 3A.

The relative lengths and widths of the support members may vary, depending on the application for the frame device, the size of the patient, the procedure being performed and the desired positioning of the patient for the procedure, and the like. In the embodiments illustrated, the first, second and third support members have substantially the same widths and the widths are substantially constant. The widths of the support members may be varied with respect to one another in alternative embodiments or variable along the length of the support member (e.g. providing tapered or contoured width support members). It may be desirable, for example, for the first, torso supporting member to have a width greater than that of one or both of the second and third thigh and lower leg supporting members. It may be desirable, for other applications, to provide support members having a tapered profile that generally matches the profile of the anatomy being supported. Thus, for example, the proximal portion of the first support member, supporting the hips, may have a wider profile in some applications, while a distal portion of the first support member, supporting the shoulders, may have a wider profile in some applications.

The relative lengths of the first, second and third support members are sized and adapted to support the relevant patient anatomy. In generally, the first support member is adapted to support the patient's flanks and a substantial portion of the patient's lateral trunk. In some embodiments, the first support member is adapted to support substantially the length of a patient's torso, from the hips to the chest. The second support member has a length that generally matches the length of a desired patient's thighs, from the hip to the knee, and the third support member has a length that supports at least a portion, 50% of a patient's lower legs, and preferably substantially the length of the patient's lower legs. In some embodiments, the first support surface has a length greater than that of the second and third support surfaces. In some embodiments, the second support surface has a length that is intermediate that of the first and third support surfaces. It will be recognized that many different dimensions may be adapted for use with patients having different proportions.

In yet additional embodiments, the length and/or width of each of the support members may be independently adjustable to provide customized fitting for individual patients. Each of the support members may have a telescoping function enabling adjustment to different lengths and/or widths, or may be provided with adjustable component extensions providing adjustment to accommodate individual patients. Other types of adjustment mechanisms may be incorporated, as is known in the art, to provide adjustment of the frame device to provide customized fitting for individual patients.

Figure 1:
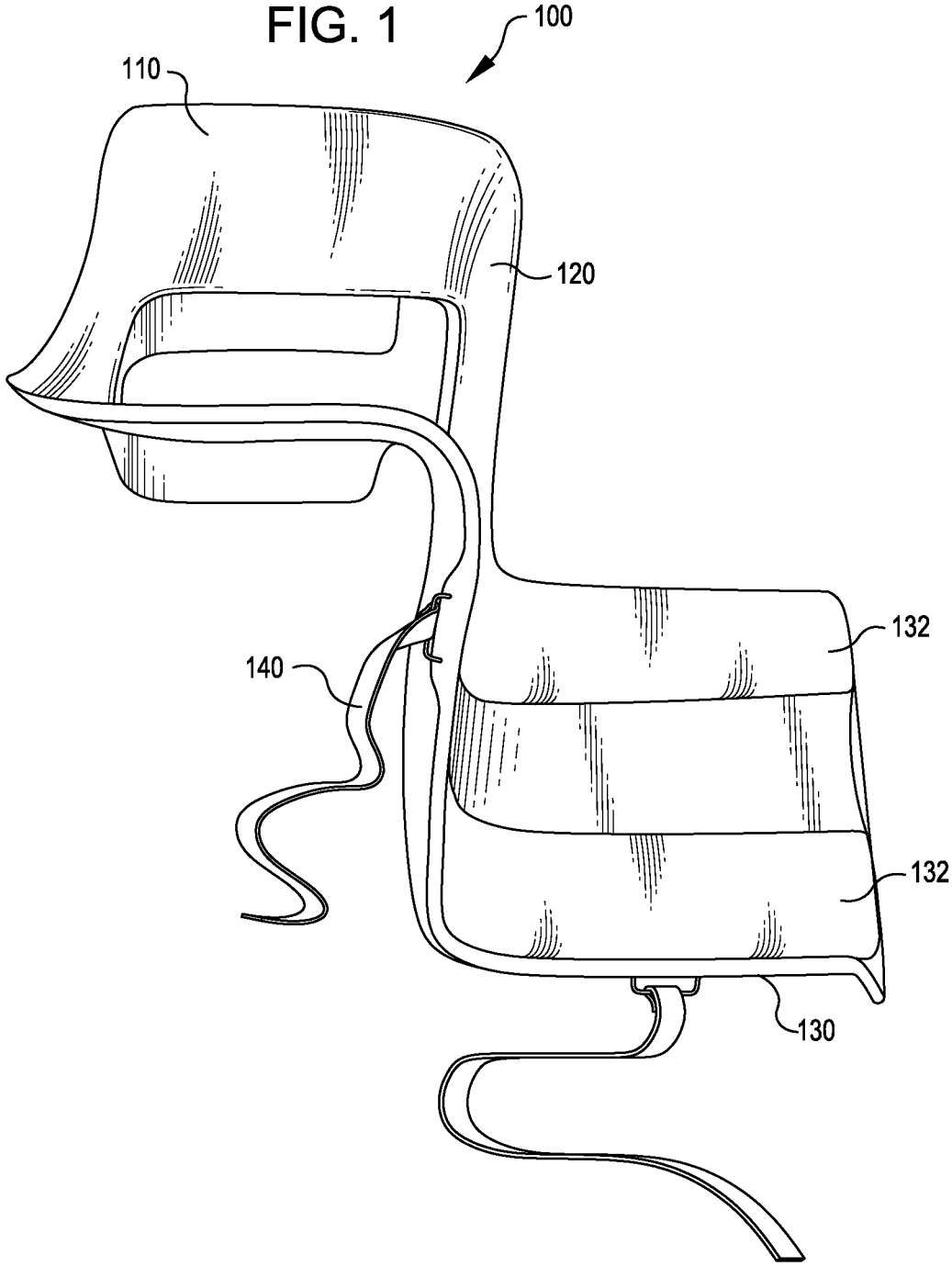
FIG. 1 shows a schematic side perspective image of a device of the present invention.
Figure 2:
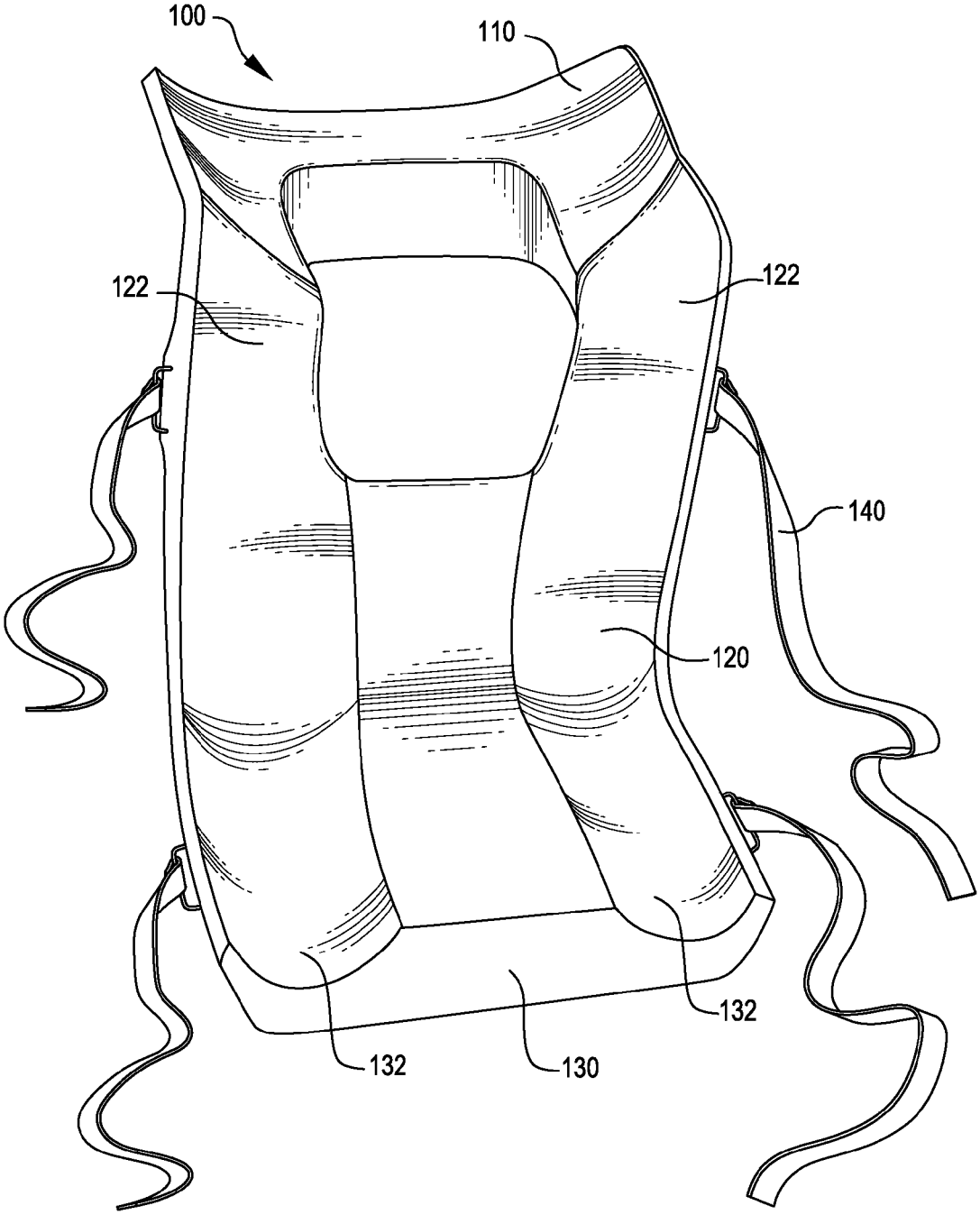
FIG. 2 shows a schematic front perspective image of the device of FIG. 1.

Support members 110, 120 and 130 may be generally flat, as described above. According to preferred embodiments, however, support members 110, 120 and 130 have contoured surfaces adapted to support the relevant portion of the patient's anatomy and to maintain the patient's anatomy in the frame device during a procedure. According to one embodiment, the third support member 130, adapted to support a patient's lower legs, may incorporate generally curved depressions 132 for supporting a patient's lower legs, which generally match the fundamental contours of patients' lower legs. As illustrated in FIGS. 1 and 2, the third support member, in one embodiment, supports the patient's lower legs in a generally spaced apart condition. The second support member, adapted to contact a patient's thighs, may likewise incorporate generally curved depressions 122 for contacting a patient's thighs and maintaining them in a stable, spaced apart condition. The depressions 122 in the second support member 120 are generally broader and deeper than those in the third support member. In these embodiments, the peripheral side surfaces of the second and third support members are generally raised. The second and third support members 120 and 130, in combination, preferably provide a substantially continuous support surface for a patient's legs and support the legs in a kneeling position.

The first support member 110, adapted to support at least a lateral portion of a patient's torso, has a generally shallow curved profile with generally raised side walls. The central portions of the first support member may be contoured along their periphery to generally accommodate a patient's abdominal and chest configurations, with one or more openings provided in the area of the patient's abdomen to allow the abdomen to be unsupported in at least a central region. In some embodiments, the first support member is designed and configured so that the abdomen is supported along the periphery of the device, but otherwise hangs free, which substantially reduces bleeding during spinal surgery. The dimensions of the first support member sidewalls may be adjusted to allow the abdomen to remain unsupported during surgery.

First and/or second support members may thus have discontinuous surfaces and may have cavities or openings providing areas where a patient's anatomy is unsupported. In the embodiments illustrated in FIGS. 1 and 2, for example, a contiguous opening is provided in the first and second support members and in the area where they interface. This opening provides an unsupported area allowing open space to accommodate a patient's abdomen and genitalia. In alternative embodiments, not illustrated, the first support member may have additional contours, or cavities or openings to accommodate other anatomical structures, such as women's breasts. One or more of the support members may include one or more cavities, openings, slots, perforations, and the like to facilitate ergonomic patient positioning, adjustability of the device, positioning of the device on a support platform, or the like, or to accommodate various types of attachment structures such as straps, fixation structures, or the like.

The depth (D) of various support members may be substantially constant, or it may vary among the support members or along each support member. In one embodiment, the first support member, adapted to support torso, has the deepest structure of the support members and is contoured and configured to positively contain and position the patient's torso in a substantially immobile condition. In another embodiment, the depth of the first support member may be adjustable to change the elevation of the patient above the supporting platform. In the schematic diagram of FIG. 3, for example, the first support member 110 is elevated at least a distance sufficient for insertion of an x-ray cassette, which allows taking an anterior/posterior x-ray during the procedure, if desired. The frame device may also be configured to allow for use of other types of imaging apparatus.

Surfaces of the frame device opposite the body contacting surfaces are designed to contact, be supported by and interface with a platform structure, such as an operating table. These frame device surfaces have generally flat portions and may be substantially flat, or may be ribbed, or provided in another configuration providing a generally flat support contour. These frame device surfaces, or portions of them, may be provided with a surface enhancement or coating, such as a rubbery or resilient or elastic material that provides a sticky or gripping action and assists in stably mounting the frame device on a support surface such as an operating table.

The support members may be contiguous with one another and fabricated as an integral, single piece device in which the support members are provided in fixed positions relative to each other. Alternatively, the angular positions of the support members may be adjustable with respect to one another to provide adjustable positioning and, optionally, to provide folding of the frame device for storage and/or transport. In one embodiment, one or more of the support members may be rotatable along an axis of interface with an adjacent support member and, in some embodiments, two or more of the support members are rotatable with respect to one another and adjustable in predetermined positions with respect to one another. This embodiment provides adjustable angular positioning of the support members relative to one another to accommodate different patient anatomies, different size patients, and to position patients in various positions for various interventions. Rotation may also allow folding of the device for convenience, storage, etc.

In another embodiment, one or more modular support members are detachable from one another and selectively and detachably connectible to one another. This embodiment may permit connection of various support members having various configurations, sizes, contours, and the like to one another, permitting the assembly of frame devices designed to accommodate the physiologies and sizes of various specific patients. The detachable support members, when assembled, may be adjustable with respect to one another by rotation, as described above. Alternatively, the support members may be assembled to mating support members in a plurality of angular orientations that are selectable by the user.

The frame device or individual support members configurable to form a frame device of the present invention are preferably constructed from a substantially rigid, lightweight material, such as metals, metal alloys, plastics, resins, fiberglass, carbon fiber composite materials, certain substantially rigid open cell foam materials, and other materials. In one embodiment, the frame device is portable, durable, and lightweight and is made of Pressed Weave Fabric 7781 with a core of 2 mm soric. The structure of the support members may be substantially flat or contoured, as described above, and it may be substantially continuous or discontinuous. Openings or cavities or perforations may be provided in one or more of the support members to provide comfort for the patient, access to a portion of the patient's anatomy, to reduce the weight and/or bulk of the frame device, or the like. Patient contact surfaces or portions of patient contact surfaces may be provided with a cushioned surface to enhance patient comfort, such as foam material. Support surface contact surfaces may be provided with gripping materials, such as resilient plastics, rubber and rubber-like materials, and the like, to promote stable positioning of the frame device on a support platform.

Attachment mechanisms, such as straps 140, may be associated with any of the support members comprising the frame device to secure the patient to the device. Adjustable straps 140 may be provided, for example, to secure a patient's thighs to the thigh support member; to secure the patient's lower legs to the lower leg support member; and to secure the patient's torso to the torso support member. One or more adjustable attachment mechanisms may thus be provided in association with the frame device and may be positionable to secure the patient to the device. One or more attachment mechanisms may also be provided for attaching the frame device to the support platform. These attachment mechanisms may be provided in the form of adjustable straps, clamps, or the like.

Figure 4:
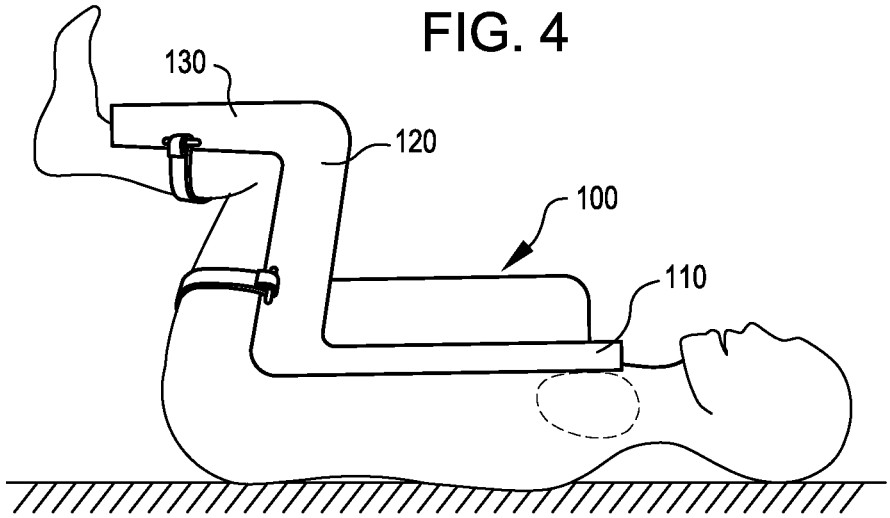
FIG. 4 shows a schematic side view of a frame device of the present invention with a patient lying supine, awake and positioned with his/her chest and torso, thighs and knees and lower legs contacting the frame device in a pre-operational position.

In use, a patient may be positioned in the frame device prior to being anesthetized while the patient is lying supine on a stretcher, as illustrated in FIG. 4. The frame device may be adjusted to accommodate the length of a patient's femur, or pads of different thickness may be positioned between the patient's knees and the frame device to provide a good "fit" in a uniform, fixed dimensional frame device. The device may be affixed to the patient by fastening straps, securing Velcro, or the like.

Figure 5:
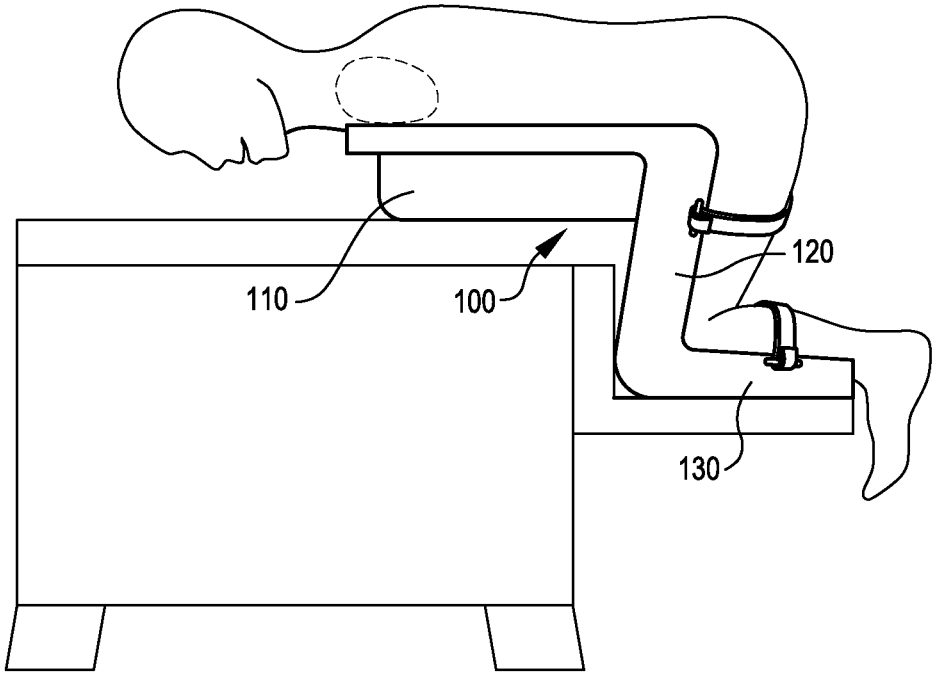
FIG. 5 shows a schematic side view of a frame device of the present invention with the patient loaded and with the device mounted on an operating platform to maintain the patient in a prone position.

As anesthesia is induced, the patient, pre-mounted on the frame device, may be rolled onto an operating table and positioned in a prone position, as illustrated in FIG. 5. Operation on the posterior thorical-lumbar spine in this position is especially advantageous, and the spinal canal remains virtually bloodless, providing excellent visualization during the surgical procedure. When the surgery is finished, the process is reversed. The patient, attached to the frame device, is rolled off the operating table and onto a stretcher in the supine position. The frame is removed while the anesthesia is reversed and the patient awakens.

I claim:

1. A frame device for positioning a patient's torso in a prone position on a platform during a surgical procedure comprising at least three support members arranged at angles to one another, wherein a first support member is configured and adapted to support a lateral portion of a patient's torso and the patient's hips, a second support member, generally contiguous with the first, is configured and adapted to contact a patient's thighs and to position the patient's thighs in a first angular position relative to the patient's hips and torso, and a third support member, generally contiguous with the second support member, is adapted to support a patient's knees and lower legs and to position the patient's lower legs in a second angular position relative to the patients torso and thighs, wherein at least one opening is provided in the area of the first and/or second support members and is configured to allow a portion of the patient's abdomen to be unsupported when the patient is otherwise supported on the frame device, and wherein the frame device is adapted to be supported on a platform structure after the patient is positioned in the frame device to position the patient's torso in a prone position on the platform structure.

2. The frame device of claim 1, fabricated as an integral, single piece device in which the support members are provided in fixed positions relative to one another.

3. The frame device of claim 1, wherein at least one support member is adjustable with respect to at least one other support member, and the angular positions of the support members are adjustable with respect to one another.

4. The frame device of claim 3, wherein the support members are adjustable to provide folding at the frame device.

5. The frame device of claim 1, wherein the first and second support members are configured and positioned relative to one another such that their support planes are arranged at an angle $\alpha$ formed between surfaces opposite the patient contacting surfaces of the first and second members of from about 60° to about 90°.

6. The frame device of claim 1, wherein the second and third support members are configured and positioned relative to one another such that their support planes are arranged at an angle $\beta$ formed between patient contacting surfaces of the second and third members of from about 60° to about 100°.

7. The frame device of claim 1, wherein the first, second and third support members have substantially the same widths and the widths are substantially constant.

8. The frame device of claim 1, wherein the first support member is adapted to support substantially the length of a patient's torso, from the hips to the chest.

9. The frame device of claim 1, wherein the first support surface has a length greater than that of the second and third support surfaces.

10. The frame device of claim 1, wherein at least one of the support members has a telescoping member enabling adjustment of the support member to different lengths and/or different widths.

11. The frame device of claim 1, wherein the third support member, adapted to support a patient's lower legs, incorporates generally curved depressions matching the fundamental contours of the patient's lower legs for supporting the patient's lower legs in a generally spaced apart condition.

12. The frame device of claim 1, wherein the first support member has a generally shallow curved profile with generally raised side walls and a central portions of the first support member is contoured along its periphery to generally accommodate a patient's abdominal and chest configurations, and wherein the at least one opening is provided in the area of the patient's abdomen to allow the patient's abdomen to be unsupported in at least a central region when the patient's torso and hips are supported by the first support member of the frame device.

13. The frame device of claim 1, wherein the first support member, adapted to support the patient's torso and hips, has a deeper structure than the second and third support members and is contoured and configured to positively contain and position the patient's torso in a substantially immobile condition.

14. The frame device of claim 1, wherein a torso supporting surface of the first support member is elevated from a lower contact surface of the first support member at least a distance sufficient for insertion of an x-ray cassette.

15. The frame device of claim 1, additionally comprising one or more adjustable attachment mechanisms positionable and fastenable to secure the patient to the device.

16. A method for preparing a patient for surgical operation on the posterior thorical-lumbar spine, comprising positioning a patient in the frame device of claim 1 when the patient is lying, supine, by positioning the first support member on a lateral portion of the patient's torso and the patient's hips, positioning the patient's thighs against the second support member, positioning the patient's knees and lower legs against the third support member, affixing the frame device to the anterior surface of the patient in this position, and then positioning the frame device on an operating table so that the first support member contacts and is supported by the operating table and the patient's torso is in a prone position.

17. The method of claim 16, wherein the patient is lying supine on a raised structure when the patient is positioned in the frame device, and positioning the patient and the frame device on the operating table involves rolling the patient and the frame device front the raised structure to the operating table.

18. The method of claim 16, wherein anesthesia is initiated after the frame device is affixed to the patient and before the patient and the frame device are positioned on the operating table.

19. The method of claim 16, wherein the patient, with the frame affixed, is moved from the position on the operating table to a position on his or her side on a raised structure following the surgical operation and the frame is removed while the patient is in the position on his or her side.

20. The frame device of claim 1, wherein the at least one opening is a contiguous opening provided in the first and second support members in the area where they interface.

* * * * *

UNITED STATES PATENT AND TRADEMARK OFFICE

CERTIFICATE OF CORRECTION

PATENT NO. : 8,443,473 B2
APPLICATION NO. : 12/428437
DATED : May 21, 2013
INVENTOR(S) : John A. Maxwell It is certified that error appears in the above-identified patent and that said Letters Patent is hereby corrected as shown below:

In the Claims:

| Col. No. | Line(s) | Edits |
|---|---|---|
| 8 | 47 | Replace "device front the raised" with --device from the raised-- |

Signed and Sealed this
Sixteenth Day of July, 2013

Teresa Stanek Rea
*Acting Director of the United States Patent and Trademark Office*